US007238086B1

(12) United States Patent
Maekawa et al.

(10) Patent No.: US 7,238,086 B1
(45) Date of Patent: Jul. 3, 2007

(54) SURFACE FINISHING METHOD FOR ALUMINUM SHAPES BY BARREL POLISHING

(75) Inventors: Kouzou Maekawa, Ikeda (JP); Yoshito Hasegawa, Ikeda (JP); Hidefumi Maekawa, Ikeda (JP); Kazuaki Takaya, Ikeda (JP); Kazunori Tsuda, Ikeda (JP)

(73) Assignee: Zeniya Aluminum Engineering, Limited, Osaka (JP)

( * ) Notice: Subject to any disclaimer, the term of this patent is extended or adjusted under 35 U.S.C. 154(b) by 0 days.

(21) Appl. No.: 11/523,287

(22) Filed: Sep. 18, 2006

(30) Foreign Application Priority Data

May 19, 2006 (JP) ..... 2006-140842

(51) Int. Cl.
*B24B 1/00* (2006.01)
*B24C 1/00* (2006.01)
*F16G 3/00* (2006.01)

(52) U.S. Cl. ..... 451/36; 451/37; 451/104; 204/32

(58) Field of Classification Search ..... 451/36, 451/37, 104, 113; 204/14, 32, 33
See application file for complete search history.

(56) References Cited

U.S. PATENT DOCUMENTS 3,969,195 A * 7/1976 Dotzer et al. ..... 205/103
4,101,386 A * 7/1978 Dotzer et al. ..... 205/211
5,800,252 A * 9/1998 Hyatt ..... 451/61
5,848,929 A * 12/1998 Hoffman ..... 451/32
6,227,942 B1 * 5/2001 Hoffman ..... 451/36
6,322,424 B1 * 11/2001 Akagi ..... 451/28
6,572,458 B2 * 6/2003 Lim ..... 451/113
6,758,729 B2 * 7/2004 Fujishiro ..... 451/328
7,040,209 B2 * 5/2006 Hoffman ..... 83/698.41

FOREIGN PATENT DOCUMENTS

JP 2740645 9/1997

* cited by examiner

*Primary Examiner*—Lee D. Wilson
*Assistant Examiner*—Alvin J. Grant
(74) *Attorney, Agent, or Firm*—Koda & Androlia

(57) ABSTRACT

A surface finishing method for aluminum shapes by barrel polishing, wherein caps are mounted at both open ends of a hollow aluminum shape, and two aluminum shapes each mounted with the caps are set on two right and left holders so as not to interfere with each other, the two aluminum shapes held above and below by the two right and left holders are next put in a barrel pot, and water, a compound, and a medium are put in the barrel pot, and then the barrel pot is closed by a lid. A plurality of barrel pots are installed on a centrifugal barreling machine, and the centrifugal barreling machine is operated so that the aluminum shapes are rotated and revolved.

6 Claims, 6 Drawing Sheets

SURFACE FINISHING METHOD FOR ALUMINUM SHAPES BY BARREL POLISHING

BACKGROUND OF THE INVENTION

1. Field of the Invention

The present invention relates to a method of finishing the outer surfaces of hollow aluminum shapes by barrel polishing.

2. Description of the Related Art

Hollow aluminum shapes produced by extrusion molding process etc. are usually cut diagonally, and then the outer surface is finished by surface polishing such as buffing, cutting, etc.

Also, though not for hollow aluminum shapes but for aluminum wheels, a polishing method that causes polishing medium to flow in a polishing vessel in which aluminum wheels are set, so that the aluminum wheels, while being rotated in the polishing vessel, is barrel-polished by the flow force of medium is known as disclosed in, for example, Japanese Patent No. 2740645 (Japanese Patent Application Laid-Open No. 9-234662).

However, aluminum shapes are not subjected to surface finishing by surface polishing or cutting operation due to their intricate shapes. Also, in surface finishing by buffing, it is difficult to scrape the surface of the aluminum shape uniformly; and droop would occur locally, and the scraping amount cannot be controlled quantitatively. On the other hand, in the surface finishing done by cutting operation, the range of surface finishing of the aluminum shape is restricted by the length of cutting tool, so that a defect such as weld marking is likely to occur.

Generally, hollow aluminum shapes have considerable variations in shape. Therefore, with the conventional surface finishing method, the entirety of the outer surface is not always finished uniformly.

On the other hand, it is preferable that the surface be finished with die marks thereon completely removed. Also, after the surface finishing, it is preferable that the cut surfaces of the aluminum shape do not droop, with the edge standing as it is. In the conventional surface finishing methods, the droop of the cut surfaces cannot be eliminated.

Further, though the inner surfaces of the hollow aluminum shapes do not need to be polished, it is desirable to avoid production of dents and droop on the inner surfaces. However, it is in fact impossible to avoid production of dents and droop on the inner surfaces of the aluminum shapes, and the medium used in the surface finishing sometimes remains in the hollow aluminum shapes.

BRIEF SUMMARY OF THE INVENTION

The present invention is to solve the problems with the conventional surface finishing method for hollow aluminum shapes.

To accomplish the object, in the present invention, a plurality of hollow aluminum shapes are installed in a barrel pot so as not to interfere with each other, and the barrel pot is rotated in a state in which a liquid, compound, and medium are put in the barrel pot, thus finishing the outer surfaces of the hollow aluminum shapes.

With this method of the present invention, the outer surfaces of the hollow aluminum shapes are finished uniformly regardless of the variations in complexity of the shape, and the surface finishing is performed without interferences of the hollow aluminum shapes with each other.

In the present invention, it is preferable that both ends of the hollow aluminum shape be held on its own axis. With this arrangement, since the hollow aluminum shape is rotated around the own axis, droop on the cut surfaces is eliminated under the condition that the aluminum shapes are prevented from interfering with each other.

Caps are preferably mounted, in the present invention, at both ends of the hollow aluminum shape. With the caps mounted, neither the compound nor the medium enters into the hollow aluminum shapes, and the inner surfaces of the hollow aluminum shapes are not damaged.

It is preferable in the present invention that the barrel pot that contains the hollow aluminum shapes be set in a centrifugal barreling machine, and the centrifugal barreling machine be rotated in different (forward and reverse) directions. With this configuration, the aluminum shapes are rotated about their own axes while being revolved by the rotating centrifugal barreling machine; accordingly, the outer surfaces of the aluminum shapes are finished uniformly regardless of the variations in shape, and die marks on the outer surfaces of the aluminum shapes are removed completely.

As seen from the above, according to the surface finishing method of the present invention, the outer surfaces of the hollow aluminum shapes are finished uniformly regardless of the shape variations, with the hollow aluminum shapes being prevented from interfering (contacting) with each other.

In addition, according to the surface finishing method of the present invention, droop on the cut surfaces is eliminated under the condition that the aluminum shapes are prevented from interfering with each other.

Furthermore, according to the surface finishing method of the present invention, the inner surfaces of the hollow aluminum shapes are prevented from being damaged.

Furthermore, according to the surface finishing method of the present invention, the outer surfaces of the aluminum shapes are finished uniformly regardless of the variations in shape, and die marks on the outer surface is removed completely.

BRIEF DESCRIPTION OF THE SEVERAL VIEWS OF THE DRAWINGS

FIG. 1A-2 is a side view thereof;

FIG. 1B-1 is a front view of another type of aluminum shape on which the surface finishing method by barrel polishing in accordance with the present invention is executed, and FIG. 1B-2 is a side view thereof;

FIG. 1C-1 is a front view of still another type of aluminum shape on which the surface finishing method by barrel polishing in accordance with the present invention is executed, and FIG. 1C-2 is a side view thereof;

FIG. 2-1 is a partially sectioned front view of the aluminum shape of FIGS. 1B-1 and 1B-2 to which caps are to be mounted at both, right and left, open ends thereof, FIG. 2-2 being a side view thereof with the caps mounted;

FIG. 3-1 is a front view of two aluminum shapes of FIGS. 1B-1 and 1B-2 mounted with caps at both ends and held above and below by two, right and left, holders so as not to interfere with each other, FIG. 3-2 being a side view thereof;

FIG. 4-1 is a front view of two aluminum shapes held above and below by two right and left holders and installed in a barrel pot containing therein water, a compound, and a medium and a lid is mounted to close the barrel pot, FIG. 4-2 being a side view thereof.

DETAILED DESCRIPTION OF THE INVENTION

Figures 1, 1A:
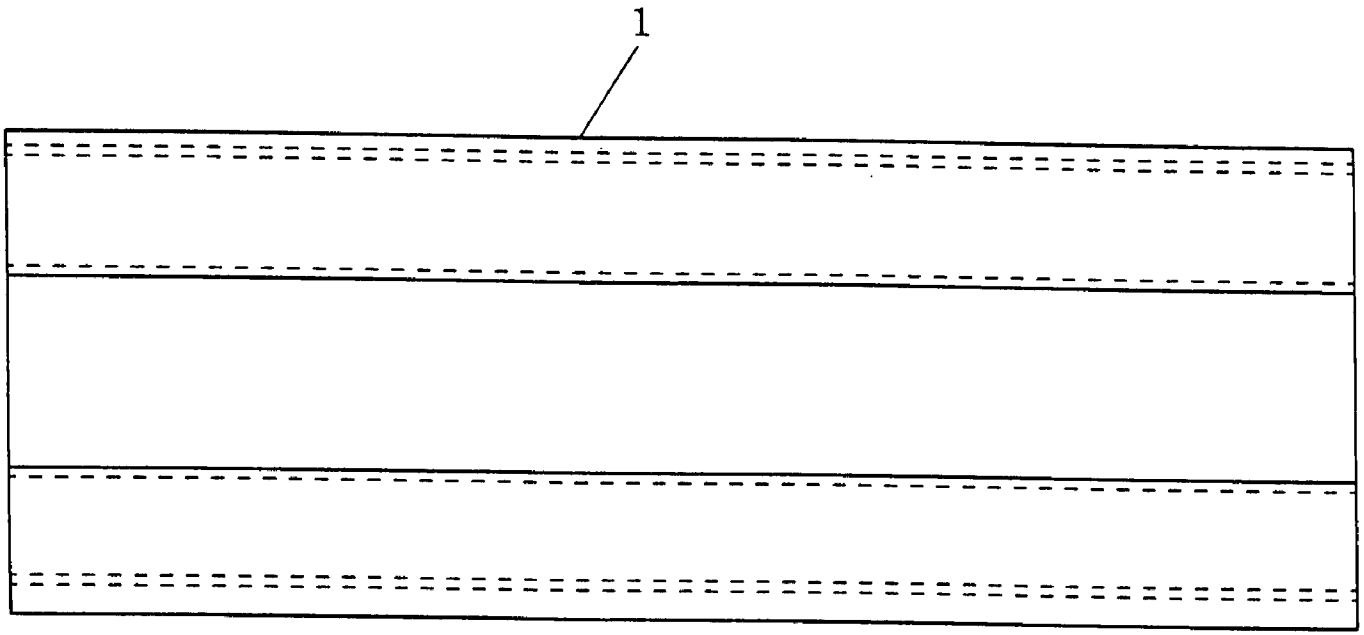
FIG. 1A-1 is a front view of an aluminum shape on which the surface finishing method by barrel polishing in accordance with the present invention is executed.

In the present invention, a work to be subjected to surface finishing (an object to be worked or surface-finished) is hollow aluminum shapes which are produced by extrusion molding and have been cut to a predetermined length. Thus, the work is, for instance, a hollow aluminum shape as denoted by reference numeral 1 shown in FIGS. 1A-1 and 1A-2, having a substantially rectangular cross-section; a hollow aluminum shape as denoted by reference numeral 2 in FIGS. 1B-1 and 1B-2, having a substantially square cross-section; and a hollow aluminum shape as denoted by reference numeral 3 in FIGS. 1C-1 and 1C-2, having a substantially rounded rectangular exterior. The surface finishing method of the present invention finishes the outer surfaces of the hollow aluminum shapes 1, 2 and 3 and completely removes die marks on their outer surfaces without damaging the inner surfaces regardless of the variations and complexity in shape.

The surface finishing method of the present invention will be described by taking the work (the object to be worked) 2 shown in FIGS. 1B-1 and 1B-2 as an example.

Figures 1, 1A, 2:
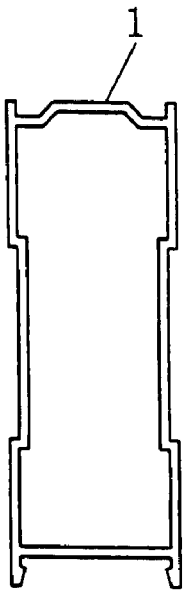

As shown in FIG. 2-1, at both of the right and left open ends of the hollow aluminum shape 2, caps 4 are mounted as indicated by arrows.

Figures 1, 3:
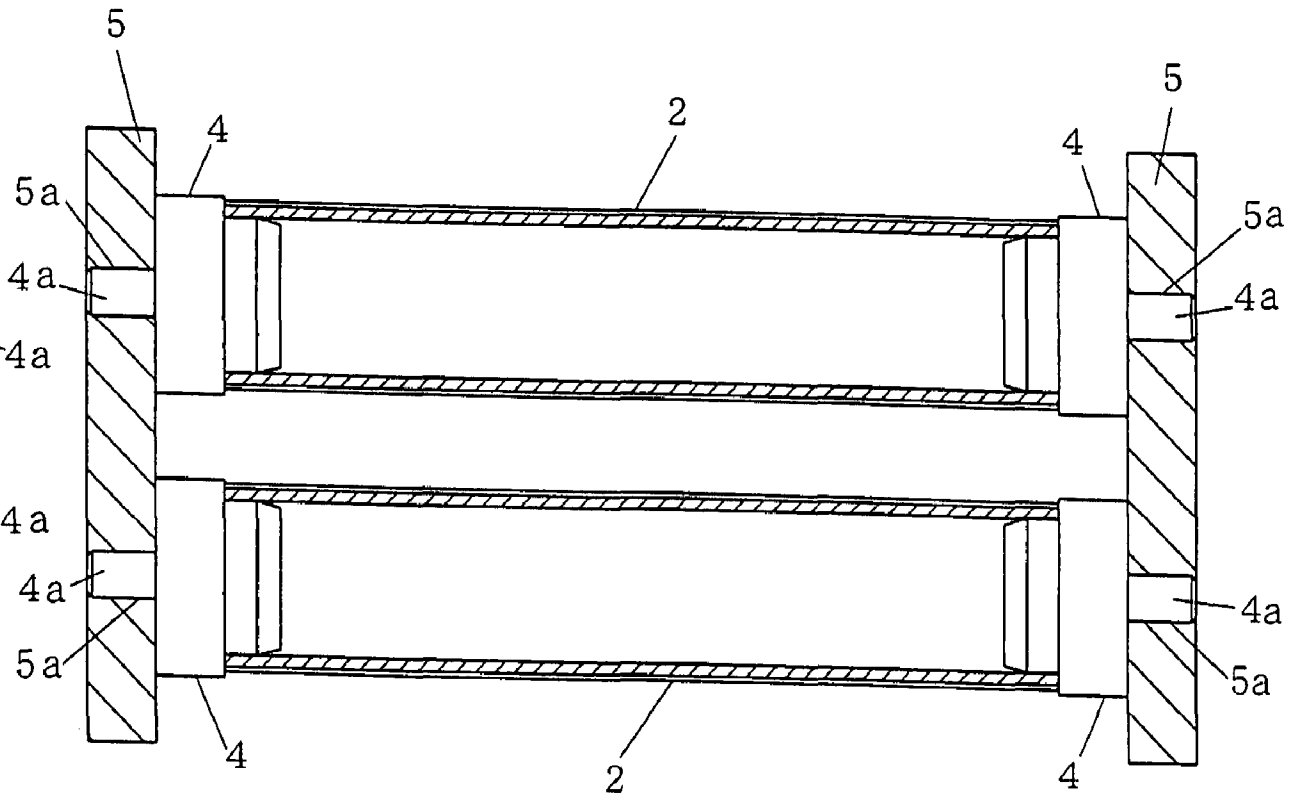
Figures 2, 3:
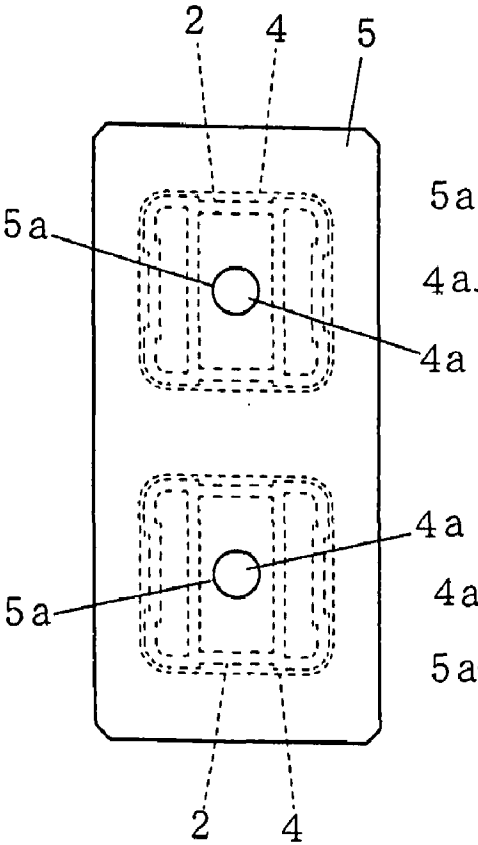

As shown in FIGS. 3-1 and 3-2, two aluminum shapes 2 on which the caps 4 are mounted are set between two right and left opposing holders 5 so that the two aluminum shapes 2 do not interfere with each other or so that the two aluminum shapes 2 are prevented from coming into contact with each other.

Figures 1, 4:
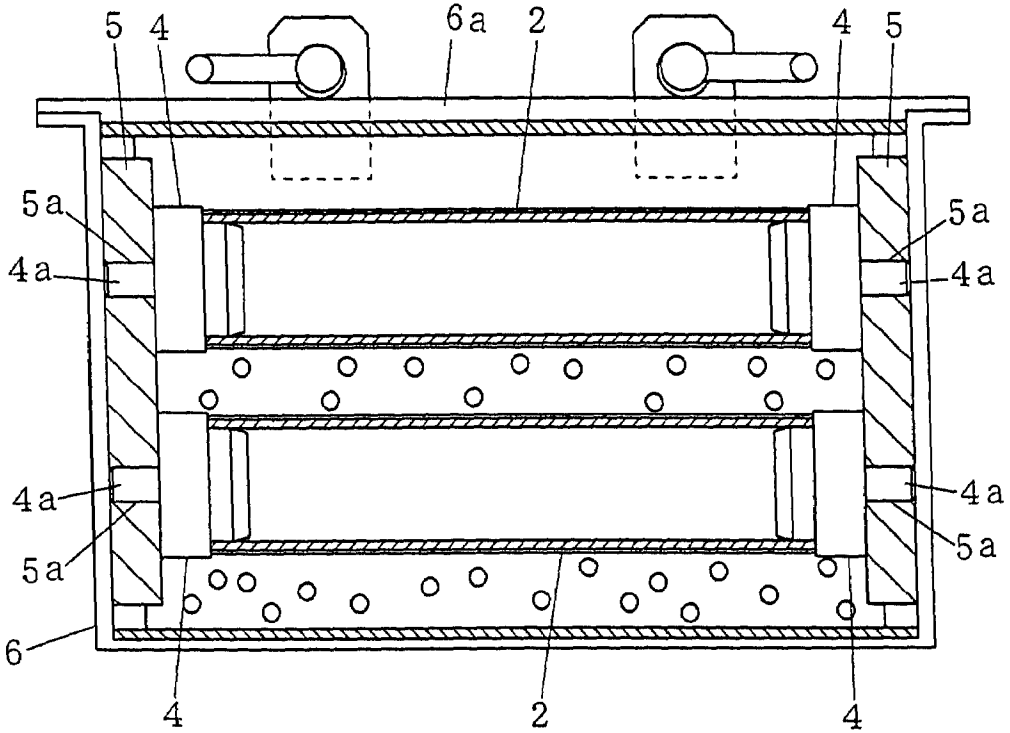
Figures 2, 4:
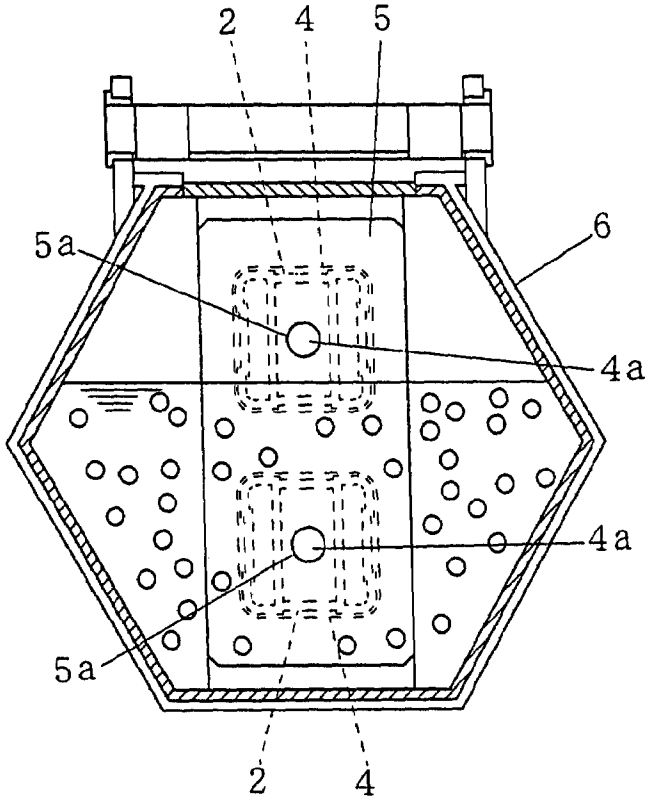

Next, the two aluminum shapes 2 held above and below by two holders 5 are put in a barrel pot 6 as shown in FIGS. 4-1 and 4-2. Water, a compound (for example, compound of wood powder, fatty acid salt, barate, silicate, carbonate and nonionic detergent (or, nonionic surface-active agent), in the shape of powder), and a medium (for example, mixture of unsaturated polyester, zirconium silicate and silica stone, which is a fixed object in the shape of circular cone (or, cone) or hemisphere circular cone) are put in the barrel pot 6, and the barrel pot 6 is closed with a lid 6*a*. In the shown embodiment, substantially half of the barrel pot 6 is filled with water, polishing compound, and polishing medium.

Figure 5:
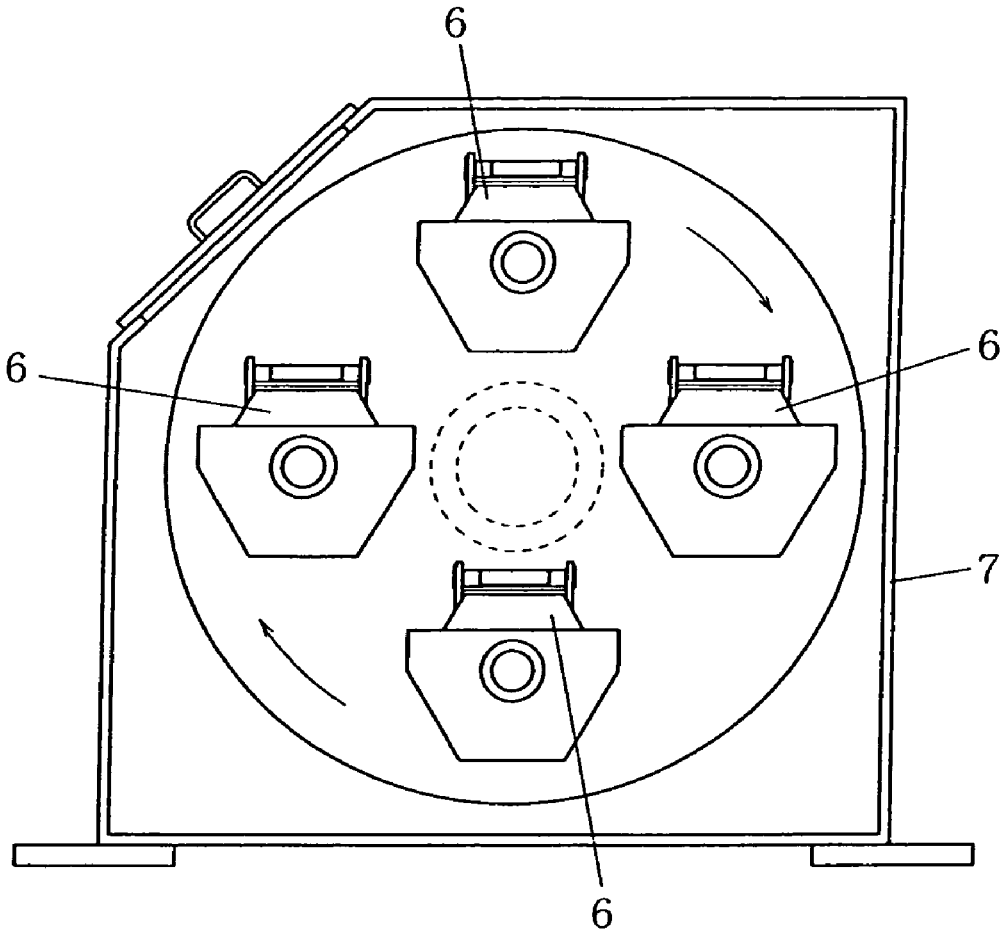
FIG. 5 is a side view of plurality of barrel pots of FIGS. 4-1 and 4-2 set in a centrifugal barreling machine.

As shown in FIG. 5, a plurality of (four (4) in the shown embodiment) such barrel pots 6 with aluminum shapes 2 therein are prepared, and these barrel pots 6 are set in a centrifugal barreling machine 7. Then, the centrifugal barreling machine 7 is rotated in the forward and reverse (opposite) directions, so that the surfaces of the aluminum shapes 2 in the barrel pots 6 are barrel polished by the agitating water, compound, and medium inside the barrel pot 6.

In the above finishing operation, the hollow aluminum shapes 2 are installed in the barrel pot 6 so that they do not interfere (or so as not to come into contact) with each other, and the barrel pots 6 are operated (rotated) in the forward and reverse directions with the liquid, compound, and medium put in the barrel pot 6. Accordingly, the aluminum shapes 2 are rotated about their own axes while being revolved by the centrifugal barreling machine 7 without occurrence of interference (contact) of the aluminum shapes 2 with each other; and regardless of the variations in shape, the outer surfaces of the aluminum shapes are finished uniformly, and die marks on the outer surfaces are removed completely.

In the shown embodiment, the two hollow aluminum shapes 2 are held vertically or above and below by the two right and left holders 5 so as not to interfere with each other. Therefore, the hollow aluminum shapes 2 are rotated around the axis O (see FIG. 2-1) while being revolved around the rotational center of the centrifugal barreling machine 7. Accordingly, since the hollow aluminum shapes 2 are rotated around the axis O while being revolved in this manner, droop on the cut surfaces of the hollow aluminum shapes 2 is eliminated in a state that the aluminum shapes 2 do not interfere with each other.

As described above, two hollow aluminum shapes 2 are rotated around the axis O while being revolved. This is done by the structure shown, for example, in FIGS. 3-1 through 4-2, in which bearing holes 5*a* are formed in the upper and lower portions of each of the two right and left holders 5, and protruding shafts 4*a* formed in the right and left caps 4 are inserted loosely or rotatably in the right and left bearing holes 5*a* of the holders 5. Another structure that can be employed in the present invention is that protruding shafts are formed in the upper and lower portions of the two right and left holders 5 so that these protruding shafts are loosely or rotatably inserted in bearing holes formed in right and left caps 4. In effect, two caps mounted at both ends of each of the hollow aluminum shapes 2 and two right and left holders 5 for holding the hollow aluminum shapes 2 in a manner that they do not interfere with each other are fitted to (or engaged with) each other, so that the two hollow aluminum shapes 2 are rotated around the axis O while being revolved.

The caps 4 are mounted at both right and left open ends of the hollow aluminum shape 2. With the caps 4 mounted, neither the compound nor the medium enters the inside of the hollow aluminum shape 2 located inside the barrel pot 6, and the inner surface of the hollow aluminum shape 2 is prevented from being damaged.

Figures 1, 1B, 2:
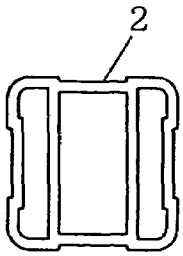
Figures 1, 1B:
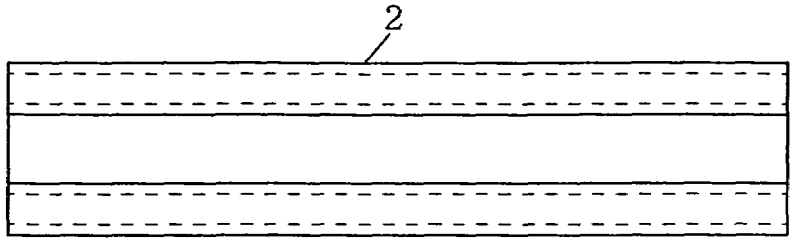
Figures 1, 1C, 2:
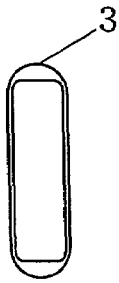
Figures 1, 1C:
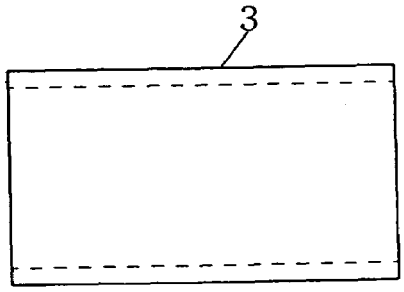
Figures 1, 2:
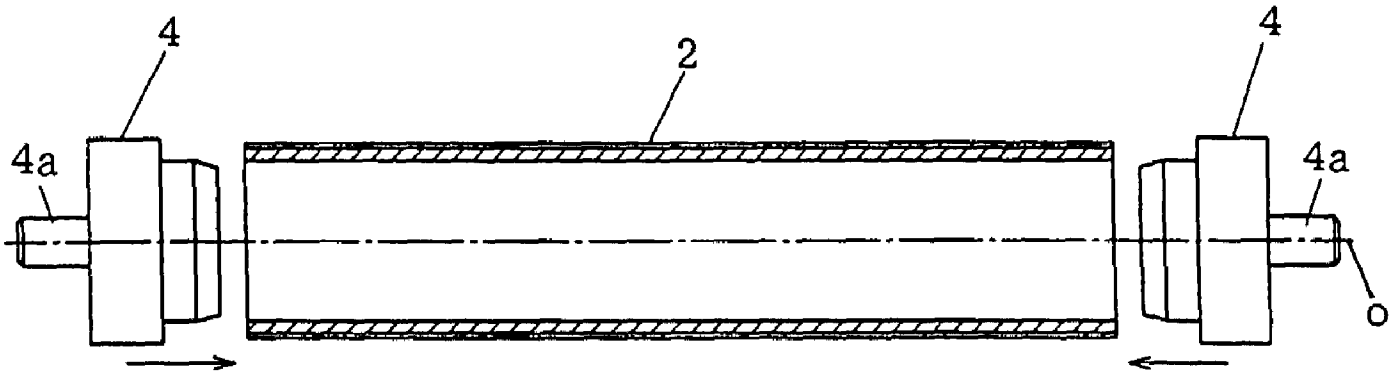

In the above description, the hollow aluminum shape 2 shown in FIGS. 1B-1 and 1B-2 is employed for describing the present invention. However, finishing of the hollow aluminum shapes 1 and 3 shown in FIGS. 1A-1 and 1A-2 and 1C-1 and 1C-2, respectively, can also be achieved in the same manner as in the aluminum shape 2 by the surface finishing method of the present invention. Furthermore, hollow aluminum shapes having shapes other than those shown in FIGS. 1A-1 through 1C-2 can also be finished in the same manner as described above.

In the above description, two aluminum shapes 2 are held above and below by the two right and left holders 5, and they are put in a barrel pot 6 that contains water, a compound, and a medium; and a plurality of barrel pots 6 containing the aluminum shapes 2 therein are installed in the centrifugal barreling machine 7; and then the surfaces of the aluminum shapes 2 in the barrel pots 6 are barrel-polished by rotating the centrifugal barreling machine 7 in the forward and reverse directions. However, in the present invention, the barrel pots 6 can be installed in a barreling machine that is different from the centrifugal barreling machine 7, such as an oscillation barreling machine or an electromagnetic barreling machine, and substantially the same effects as those in the case where the barrel pots 6 are installed in the centrifugal barreling machine 7 as described above can be accomplished. Nonetheless, if the barrel pots 6 are set in the centrifugal barreling machine 7, the barrel pots 6 are rotated while being revolved by the rotation of the centrifugal barreling machine 7 in the forward and reverse directions; accordingly, the efficiency of surface finishing of the aluminum shapes 2 by means of barrel polishing is deemed to be the highest.

The advantages of producing hollow aluminum shapes by extrusion molding are that the design value of the continuous shape is high, so that hollow aluminum shapes excellent in terms of design are easily produced, and hollow aluminum shapes having unique appearances and performances are obtainable. On the other hand, the disadvantage in producing hollow aluminum shapes by extrusion molding is that the hollow aluminum shapes have properties peculiar to an aluminum material, such as a die mark and weld marking, and these properties show in the appearance of the hollow aluminum shapes after extrusion molding.

However, according to the surface finishing method of the present invention, since the above-described surface finishing is performed, the above-described drawbacks in the case that hollow aluminum shapes are produced by extrusion molding are overcome while making the most of the above-described advantages.

The invention claimed is:

1. An outer surface finishing method for aluminum shapes by barrel polishing, comprising the steps of:

installing a plurality of hollow aluminum shapes in at least one barrel pot so as not to interfere with each other, putting a liquid, compound, and medium in the barrel pot to fill said barrel pot to at least substantially half way, installing said barrel pot in a centrifugal barreling machine, and rotating the centrifugal barreling machine thus executing surface-finish on outer surfaces of the hollow aluminum shapes.

2. The outer surface finishing method for aluminum shapes by barrel polishing according to claim 1, wherein both ends of each of the hollow aluminum shapes are held on an axis thereof.

3. The outer surface finishing method for aluminum shapes by barrel polishing according to claim 1, wherein caps are mounted at both ends of each of the hollow aluminum shapes.

4. The outer surface finishing method for aluminum shapes by barrel polishing according to claim 2, wherein caps are mounted at both ends of each of the hollow aluminum shapes.

5. The outer surface finishing method for aluminum shapes by barrel polishing according to claim 1, wherein the centrifugal barreling machine is rotated in forward and reverse directions.

6. The outer finishing method according to claim 4, wherein the liquid is water.

* * * * *